US009109271B2

(12) United States Patent
Donahue et al.

(10) Patent No.: US 9,109,271 B2
(45) Date of Patent: Aug. 18, 2015

(54) NICKEL CONTAINING HYPEREUTECTIC ALUMINUM-SILICON SAND CAST ALLOY

(71) Applicant: Brunswick Corporation, Lake Forest, IL (US)

(72) Inventors: Raymond J. Donahue, Fond du Lac, WI (US); Terrance M. Cleary, Fond du Lac, WI (US); Kevin R. Anderson, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 29 days.

(21) Appl. No.: 13/828,765

(22) Filed: Mar. 14, 2013

(65) Prior Publication Data

US 2014/0271342 A1 Sep. 18, 2014

(51) Int. Cl.

| | |
|---|---|
| ***C22C 21/02*** | (2006.01) |
| *C22C 21/06* | (2006.01) |
| *C22C 21/00* | (2006.01) |

(52) U.S. Cl.
CPC ..... *C22C 21/02* (2013.01)

(58) Field of Classification Search
USPC ..... 420/532, 547, 550
See application file for complete search history.

(56) References Cited

U.S. PATENT DOCUMENTS

| | | | |
|---|---|---|---|
| 1,947,121 | A | 2/1932 | Bonsack |
| 2,357,452 | A | 9/1944 | Euclid |
| 3,092,744 | A | 6/1963 | Stonebrook |
| 3,726,672 | A | 4/1973 | Lindberg |
| 3,881,879 | A | 5/1975 | Singleton, Jr. et al. |
| 4,297,976 | A | 11/1981 | Bruni et al. |
| 4,603,665 | A | 8/1986 | Hesterberg et al. |
| 4,821,694 | A | 4/1989 | Hesterberg et al. |
| 4,966,220 | A | 10/1990 | Hesterberg et al. |
| 4,969,428 | A | 11/1990 | Donahue et al. |
| 5,129,378 | A | 7/1992 | Donahue et al. |
| 5,165,464 | A | 11/1992 | Donahue et al. |

(Continued)

FOREIGN PATENT DOCUMENTS

| | | |
|---|---|---|
| EP | 0377615 B1 | 7/1991 |
| EP | 0708884 B1 | 5/1996 |

(Continued)

OTHER PUBLICATIONS

Best Practices in Aluminum Metalcasting, AFS Book, Copyright 2014, Geoffrey K. Sigworth on p. 121, in Figs. 8-16 (right side).

(Continued)

*Primary Examiner* — Kaj K Olsen
*Assistant Examiner* — Alexander Polyansky
(74) *Attorney, Agent, or Firm* — Andrus Intellectual Property Law, LLP

(57) ABSTRACT

A nickel containing hypereutectic aluminum-silicon sand cast alloy is disclosed herein containing 18-20% by weight silicon, 0.3-1.2% by weight magnesium, 3.0-6.0% by weight nickel, 0.6% by weight maximum iron, 0.4% by weight maximum copper, 0.6% by weight maximum manganese, 0.1% maximum zinc and balance aluminum. The alloy may have a more narrow nickel content of 4.5%-6.0% by weight, and up to 2% by weight cobalt. The alloy may be substantially free from iron, copper and manganese. The alloy of the present invention is preferably sand cast, and most preferably lost foam cast with a pressure of 10 ATM to produce engine parts with high thermal properties that are easily machined.

15 Claims, 2 Drawing Sheets

(56) References Cited

U.S. PATENT DOCUMENTS

Figure 1:
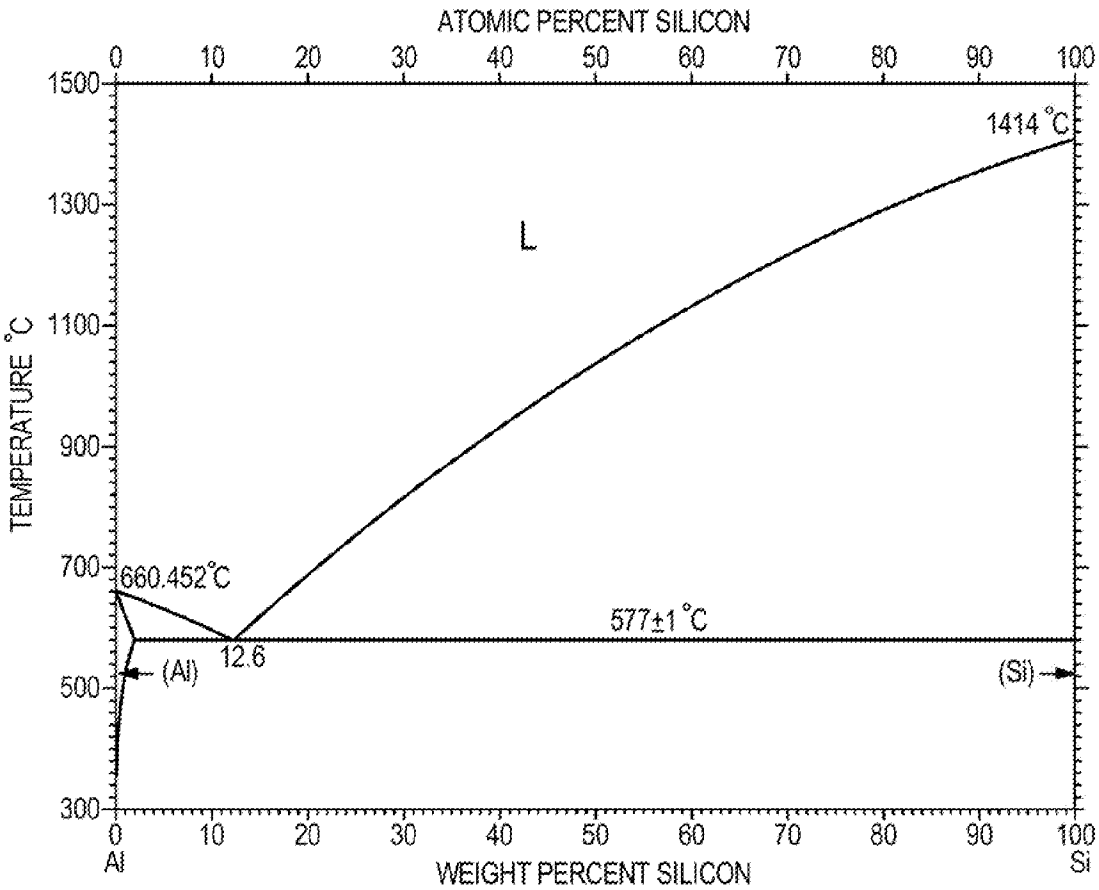

| | | | |
|---|---|---|---|
| 5,234,514 | A | 8/1993 | Donahue et al. |
| 5,253,625 | A | 10/1993 | Donahue et al. |
| 5,290,373 | A | 3/1994 | Donahue et al. |
| 5,303,682 | A | 4/1994 | Donahue et al. |
| 5,355,930 | A | 10/1994 | Donahue et al. |
| 5,355,931 | A | 10/1994 | Donahue et al. |
| 5,383,429 | A | 1/1995 | Donahue et al. |
| 5,421,292 | A | 6/1995 | Hoffman et al. |
| 5,564,374 | A | 10/1996 | Hoffman et al. |
| 5,755,271 | A | 5/1998 | Williamson |
| 5,965,829 | A | 10/1999 | Haynes et al. |
| 6,024,157 | A | 2/2000 | Donahue et al. |
| 6,332,906 | B1 | 12/2001 | Haynes et al. |

FOREIGN PATENT DOCUMENTS

| | | | | |
|---|---|---|---|---|
| EP | 1469091 | A1 * | 10/2004 | ..... C22C 1/02 |
| EP | 1591792 | A2 | 11/2005 | |
| GB | 1437144 | A | 5/1976 | |
| WO | 8902326 | A1 | 3/1989 | |
| WO | 9012899 | A1 | 11/1990 | |
| WO | 9503485 | A1 | 2/1995 | |

OTHER PUBLICATIONS

Fundamentals of Aluminium Metallurgy, Production, Processing and Applications, edited by Robert Lumley, 2011, pp. 289, 290.

Aluminum Products and Their Fabrication, Junius David Edwards et al., Copyright 1930, pp. 88-90.

* cited by examiner

NICKEL CONTAINING HYPEREUTECTIC ALUMINUM-SILICON SAND CAST ALLOY

CROSS-REFERENCE TO RELATED APPLICATION(S)

Not Applicable.

STATEMENT REGARDING FEDERALLY SPONSORED RESEARCH OR DEVELOPMENT

Not Applicable.

INCORPORATION-BY-REFERENCE OF MATERIAL SUBMITTED ON A COMPACT DISC

Not Applicable.

BACKGROUND

The eutectic structure of aluminum silicon alloys has long been studied to determine the mechanical properties of the alloys, see U.S. Pat. Nos. 1,387,900 and 1,410,461. After more than 80 years of studying this eutectic structure, those skilled in the art now understand that sodium or strontium additions to the eutectic melt in only 100 ppm concentrations changes the size and morphology of the eutectic silicon phase resulting in a significant increase in the alloy's ductility.

Still, hypereutectic aluminum silicon alloys are not used to a great extent in sand casting processes because they are difficult to machine and because the primary silicon particle size is larger at sand casting cooling rates than at cooling rates for casting processes that use metal molds. As a result, there is a requirement to control the casting's microstructure in order to achieve an acceptable machinability. Achieving an acceptable machinability in a hypereutectic alloy is typically accomplished through phosphorus additions to the alloy melt to refine the primary silicon particle size. However, phosphorus prefers to form phosphides with common melt additives such as strontium and sodium rather than reacting with aluminum to form aluminum phosphide. This is problematic because aluminum phosphide is the nucleus for primary silicon formation in the eutectic structure of hypereutectic aluminum silicon alloys. Accordingly, the eutectic structure of phosphorus containing hypereutectic aluminum silicon alloys is almost always unmodified.

Thus, phosphorus refined, solution heat treated, quenched and aged, hypereutectic aluminum silicon structures provide the baseline for machinability, yet this baseline generally requires diamond tooling for proper machining. In contrast, eutectic aluminum silicon alloys and hypoeutectic aluminum silicon alloys, where the eutectic silicon structure is modified with strontium or sodium additions, have increased ductilities and are easier to machine. However, when the modified eutectic in the hypoeutectic alloy structures are compared to unmodified structures, the strontium or sodium modified eutectic structures exhibit nearly identical machinability in the heat treated condition with the unmodified structures. It is believed that this equivalence in machinability is due to the eutectic silicon phase occurring as a continuous phase in the eutectic whether the eutectic is modified or unmodified. Further, since it is always easier to machine the less ductile T6 or T7 heat treated condition, compared to the as cast condition, there is an effect that base metal properties have on machinability that is quite significant. Accordingly, there is not a predictable treatment that improves machinability of hypereutectic aluminum silicon alloys.

Hypereutectic aluminum alloy B391 (AA B391) includes 18 to 20% silicon by weight for wear resistance, 0.4 to 0.7% by weight magnesium for aging response to increase strength and has maximums for iron and copper of 0.2% by weight for good sand casting attributes, and is the only hypereutectic aluminum silicon alloy registered for sand casting by the Aluminum Association. The 0.2% by weight maximum copper constituency ensures that (for any given silicon content), the solidification range, that is, the temperature difference between the liquidus and solidus, is at a minimum. In comparison. AA 390 has the same range of elements as AA B391, except AA 390 has 4.5% by weight copper constituency. Thus, the narrow solidification range of AA B391 occurs primarily because the significantly lower copper constituency raises the solidus melting point by nearly 1000 Fahrenheit compared to AA 390.

The narrow solidification range of AA B391 is important because the primary silicon, which is less dense than the molten alloy, it is less likely to float and segregate upon precipitation in an alloy of narrow solidification range. The low iron and manganese contents of AA B391 are desirable and are particularly attractive for a sand cast hypereutectic aluminum silicon alloy that solidifies slowly. The mechanical properties of AA B391 are significantly degraded when the iron phase grows large during the slow cooling, because a needle like morphology results for the iron phase, degrading mechanical properties.

Historically, nickel was an essential element in Y alloy (4% by weight copper, 2% by weight nickel, 1.5% by weight magnesium, balance aluminum), developed during World War I. Nickel is present in only three registered alloys with the Aluminum Association today in concentrations between 2% and 3% nickel. Thus, it is known to use nickel as a minor constituent in some aluminum copper alloys, such as AA 242, AA 336 and AA 393, wherein the element imparts high strength at high temperature. AA 242 has a formulation of 3.7 to 4.5% by weight copper, 1.2 to 1.7% by weight magnesium, 1.8 to 2.3% by weight nickel and balance aluminum. AA 336 has 11 to 13% by weight silicon, 1.2% by weight maximum iron, 0.5 to 1.5% by weight copper, 0.7 to 1.3% by weight magnesium, 2.0 to 3.0% by weight nickel and balance aluminum. Similarly, AA 393 has a hypereutectic formulation of 21 to 23% by weight silicon, 1.3% by weight maximum iron, 0.7 to 1.1% by weight copper, 0.7 to 1.3% by weight magnesium, 2.0 to 2.5% by weight nickel and balance aluminum.

Additionally, more than forty years ago, there was considerable interest in the Al—Ni—$Al_3$ eutectic, unidirectionally solidified, as a fiber reinforced material, especially for high temperature applications. As identified in the reference to B. K. Agrawal, Met A 6, 152605, in the book, Aluminum Alloys: Structure and Properties by L. F. Mondolfo page 339 [Butterworth Publications Ltd, 1976], by directional freezing, the eutectic may be made to crystallize with the $NiAl_3$ fibers aligned in the direction of growth, with the spacing between the fibers dependent on the freezing rate. The same reference indicates that additions of barium, cerium and cesium to the unidirectionally solidified Al—$NiAl_3$ eutectic changes the solidification pattern from colony to dendritic It is also known that aging after quenching from high temperature does not produce hardening of binary Al—Ni alloys to be of practical use.

However, the addition of nickel in concentrations approaching 6% to aluminum silicon magnesium casting alloys, aluminum silicon copper casting alloys, aluminum silicon copper magnesium alloys or aluminum copper casting alloys have not been studied. This is because it is known that nickel additions of 2% by weight or less have the effect of reducing hot shortness in some castings and also have the effect of reducing the coefficient of thermal expansion.

Additionally, U.S. Pat. No. 6,168,675 describes a hypereutectic aluminum silicon alloy having 2.5 to 4.5% by weight nickel, but with a very high manganese content of 1.2% maximum by weight and a very high iron content of 1.2% by weight maximum. This alloy is intended for the die casting process or permanent mold casting process to make vehicular disk brake components. Because of the high manganese and iron contents, this alloy has a very high heavier metal content that requires a high holding temperature to prevent the heavier metals from dropping out. Furthermore, the high manganese content is necessary to modify the needle like beta iron aluminum phase to the alpha iron aluminum phase and increases the yield strength, tensile strength and elongation, both at ambient and high temperatures. Notwithstanding the attributes imparted to the alloy from high levels of manganese and iron, the alloy of U.S. Pat. No. 6,168,675 would not be suited for a slow cooling process like sand, lost foam or investment casting because the large needle like iron phase particles would form, even with the high levels of manganese, thereby hindering feeding during solidification which results in increased porosity levels and decreased ductility levels.

Sand casting processes are increasingly being used to cast complex metal products. Sand casting procedures include lost foam casting, lost foam with pressure casting, green sand casting, bonded sand casting, precision sand casting and investment casting. Perhaps the most beneficial and economical of these types of castings is lost foam casting with pressure. Such a method is described in U.S. Pat. No. 6,763,876 entitled Method And Apparatus For Lost Foam Casting Of Metal Articles Using External Pressure, the subject matter of which is incorporated herein by reference.

SUMMARY

The present invention is directed to a hypereutectic aluminum silicon alloy having improved machinability with additions of nickel consisting essentially of 18 to 20% by weight silicon, 0.3 to 1.2% by weight magnesium, 3.0 to 6.0% by weight nickel, 0.6% by weight maximum iron, 0.4% by weight maximum copper, 0.8% by weight maximum manganese, 0.5% by weight maximum zinc and the balance aluminum. The nickel content of the alloy of the present invention may be modified to constitute 4.5% to 6% by weight, and be substantially free of iron and manganese. The alloy of the present invention has additional benefits, particularly when compared to copper containing hypereutectic aluminum silicon alloys. Such benefits include improved feeding of shrinkage porosity through an Al—$NiAl_3$ eutectic structure under ten atmospheres of isostatic gas pressure and improved galvanic couple compatibility (over an Al—Ni galvanic couple) on the micron level for constituents in the microstructure for a wet gasket joint containing salt water.

The present invention discloses a hypereutectic alloy composition that, upon solidification, goes through an Al—$NiAl_3$ eutectic reaction, and involves the creation of a Al—$NiAl_3$ phase, on slow cooling (as opposed to fast cooling of the die casting process), that resembles a "Chinese script" morphology. This microstructural morphology is embedded in the eutectic that surrounds the primary silicon, outlining and partitioning the primary silicon particles, while providing a semi-continuous fracture path through the eutectics that imparts good machinability to a hypereutectic aluminum silicon alloy that normally is difficult to machine. Further, it is important that the alloy of the present invention be substantially free of iron and manganese because if iron phases and manganese phases are in the microstructure, they clog interdendritic passageways and hinder feeding, decreasing machinability even when ten atmospheres of isostatic pressure is applied.

Thus, the $NiAl_3$ Chinese script morphology exists throughout the microstructure of the alloy of the present invention to enhance machinability and facilitate improved elevated temperature properties. This finding is quite surprising since normally microstructural features that enhance machinability, such as sulfides in steel, also degrade mechanical properties.

The hypereutectic aluminum silicon alloy of the present invention also has anticipated use in the lost foam casting process for engine components such as engine blocks, engine heads, and pistons, particularly such engine components used in salt water and thus requiring high corrosion resistance and high mechanical properties (through low porosity levels) both at ambient temperatures and elevated temperatures.

Accordingly, the hypereutectic aluminum silicon sand cast alloy of the present invention consists essentially of 18-20% by weight silicon, 0.3-1.2% by weight magnesium, 3.0-6.0% by weight nickel, 0.8% by weight maximum iron, 0.4% by weight maximum copper, 0.6% by weight maximum manganese, 0.5% by weight maximum zinc, and the balance aluminum. Alternatively, the copper content may be 0.2% by weight maximum copper, the iron content may be 0.6% by eight maximum iron, and the zinc content may be 0.1% by weight maximum zinc. Alternatively, the aluminum silicon sand cast alloy of the present invention may consist essentially of 18-20% by weight silicon, 0.3-0.7% by weight magnesium, 3.0-6.0% by weight nickel, 0.2% by weight maximum iron, 0.2% by weight maximum copper, 0.3% by weight manganese, 0.1% by weight maximum zinc, and the balance aluminum, wherein the alloy sand cast using a lost foam casting process with the pressure. As a further alternative, the hypereutectic aluminum silicon alloy of the present invention may consist essentially of 18-20% by weight silicon, 0.3-1.2% by weight magnesium, 4.5-6.0% by weight nickel, 0.8% by weight maximum iron, 0.4% by weight maximum copper, 0.6% by weight maximum manganese, 0.5% by weight maximum zinc, and the balance aluminum.

When the hypereutectic aluminum sand cast alloy of the present invention is cast, the sand casting procedure is selected from one of the following sand cast procedures: Lost Foam Casting, Lost Foam Casting with Pressure, Green Sand Casting, Bonded Sand Casting, Precision Sand Casting, or Investment Sand Casting.

In one embodiment, the hypereutectic aluminum silicon sand cast alloy of the present invention has a T6 heated treated microstructure of primary silicon particles embedded in eutectics of Al—Si and Al—$NiA_3$, and is substantially free of unsolutionized $Mg_2Si$ phases and $Cu_3$,$NiAl_6$ in Chinese script form. In this embodiment of the alloy, the amount of the eutectic $NiAl_3$ phase is between 5% and 15% by weight, and by further be between 5% and 14.3% by weight. Additionally, the eutectic $Cu_3NiAl_6$ phases are present at less than 1% by weight.

As aforementioned, the nickel constituency of the hypereutectic aluminum silicon sand cast of the present invention may be narrowed to the 4.5-6.0% by weight nickel. If this constituency is used, the alloy has a T6 heat treated microstructure wherein primary silicon particles are embedded in eutectics of Al—Si and Al—$NiAl_3$ and the microstructure is generally free of unsolutionized $Mg_2Si$ phases and $Cu_3NiAl_6$ in Chinese script form, while the amount of the eutectic $NiAl_3$ phase is greater than 10% by weight.

Additional adjustments to the hypereutectic aluminum silicon sand cast alloy constituency may be made. Particularly, the iron content may be lowered to be 0.2% by weight maximum iron; the copper content may be lowered to 0.2% by weight maximum copper; the manganese content may be lowered to 0.3% by weight maximum manganese; and the magnesium content may be modified to 0.75-1.2% by weight. Further, up to 2% by weight nickel may be substituted with up to 2% by weight cobalt. Also, a grain or silicon refining element may be added to the alloy. Preferably, the grain or silicon refining elements are either titanium or phosphorus.

When the hypereutectic aluminum silicon sand cast alloy of the present invention is cast using a lost foam casting process with pressure, the alloy would preferably consist essentially of 18-20% by weight silicon, 0.3-7% by weight magnesium, 3.0-6.0% by weight nickel, 0.2% by weight maximum iron, 0.2% by weight maximum copper, 0.3% by weight maximum manganese, 0.1% by weight maximum zinc and the balance aluminum. The alloy may further include phosphorus in the range of 0.005%-0.1% by weight for refining purposes. Preferably, pressure is applied to a molten metal casting in accordance with procedures of U.S. Pat. No. 6,763,876 the substance of which is incorporated herein by reference. Most preferably, pressure is applied after ablation of a polymeric foam gating system that connects the source of molten liquid metal to a polymeric foam pattern, but before molten metal fully ablates the polymeric foam pattern. Pressure is applied in the range of 5.5-15 atmospheres at a rate faster than 1 atmosphere per 12 seconds. The polymeric foam pattern may have nearly any configuration, however, to take advantage of the improved galvanic coupled compatibility of the present invention, the pattern is most preferably of an engine head, pistons for internal combustion engines, or engine blocks to be used in engines that run in salt water environment. Internal combustion engine blocks cast with the hypereutectic aluminum silicon sand cast alloy in the present invention exhibit a porosity level of less than 0.5%.

The resulting as cast Lost Foam microstructure comprises primary silicon particles embedded in a mixture of aluminum-silicon eutectic, wherein the eutectic silicon phase is unmodified and an aluminum-$NiAl_3$ eutectic is present and further wherein the $NiAl_3$ phase comprises a Chinese script morphology imparting improved machinability on the alloy. Specifically, if the weight percent of $NiAl_3$ phase exceeds the weight percent of a primary aluminum silicon phase, the alloy provides a low energy fracture path in the machining process for improved machinability. The machinability of the alloy improves linearly when the nickel constituency increases from 3% by weight to 6% by weight nickel, because the weight percent of $NiAl_3$ correspondingly increases from 7% to 14% in the eutectic. When the hypereutectic aluminum silicon sand cast alloy of the present invention is cast using the casting process of U.S. Pat. No. 6,763,876, the alloy is cooled at a rate typical of sand casting cooling. The microstructure of such an alloy exhibits less coring than if they alloy was cast using a die casting process, and, advantageously, the porosity level is generally less than 1%.

It is contemplated that the hypereutectic aluminum silicon alloy of the present invention may be used for other types of casting. If this is the case, the nickel constituency should be 4.5-6.0% by weight nickel with corresponding 0.8% by weight maximum iron constituency. Such an alloy may be used in either the die casting process or in a permanent mold casting process or in a semi-permanent mold casting process with sand cores, as well as the sand casting procedures described, above. Such an alloy has a T6 heat treated microstructure of primary silicon particles embedded in eutectics of Al—Si and Al—$NiAl_3$, and is generally free of unsolutionized $Mg_2Si$ phases and $Cu_3NiAl6$ in Chinese script form. The amount of the eutectic $NiAl_3$ phase is between 5% and 15% by weight, and the $NiAl_3$ phase has a Chinese script morphology.

DETAILED DESCRIPTION OF BINARY AND TERNARY PHASE DIAGRAM DRAWINGS

FIG. 1 demonstrates the binary Al—Si phase diagram.

Figure 2:
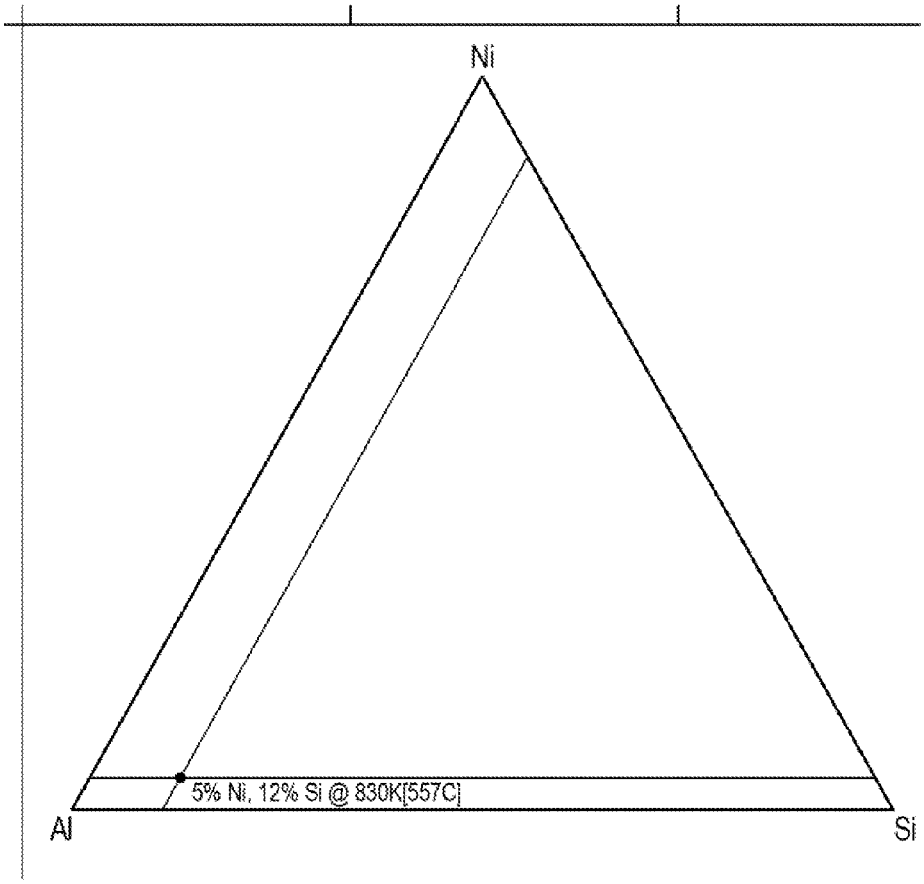

FIG. 2 is a ternary diagram for a three phase equilibrium for the Al—Si—$NiAl_3$ ternary system.

DETAILED DESCRIPTION OF THE INVENTION

The hypereutectic aluminum silicon sand cast alloy of the present invention preferably has the following constituency in weight percentage: 18-20% silicon, 0.3-1.2% magnesium, 3.0-6.0% nickel, 0.8% maximum iron, 0.4% maximum copper, 0.6% maximum manganese, 0.5% maximum zinc, balance aluminum. Alternatively, the copper content may be 0.2% by weight maximum copper, the iron content may be 0.6% by eight maximum iron, and the zinc content may be 0.1% by weight maximum zinc.

The hypereutectic aluminum silicon sand cast alloy of the present invention may have a more narrow nickel content of 4.5-6.0% by weight; a more narrow iron content of 0.2% by weight maximum, a more narrow copper content of 0.2% by weight maximum; a more narrow manganese content of 0.3% by weight maximum and a more narrow magnesium content of 0.75-1.2% by weight. Furthermore, up to 2.0% by weight nickel to be substituted with up to 2.0% by weight cobalt, and grain refining elements such as titanium or phosphorus may be added.

The alloy of the present invention may be sand cast using known sand cast procedures such as Lost Foam Casting, Lost Foam Casting with Pressure, Green Sand Casting, Bonded Sand Casting, Precision Sand Casting, or Investment Casting. If the hypereutectic aluminum silicon alloy is cast using a lost foam casting process with pressure, the alloy may have the following constituency in weight percentage: 18-20% silicon 0.3-0.7% magnesium, 3.0-6.0% nickel, 0.2% maximum iron, 0.2% maximum copper, 0.3% maximum manganese 0.1% maximum zinc, balance aluminum. A beneficial lost foam casting process with pressure is described in U.S. Pat. No. 6,763,876. If phosphorus is added as a refiner, phosphorus should be added to the composition in the range of 0.005%-0.1% by weight.

Alternatively, the hypereutectic aluminum silicon alloy of the present invention may have the following constituency in weight percentage: 18-20% silicon, 0.3-1.2% magnesium, 4.5-6.0% nickel, 0.8% maximum iron, 0.4% maximum copper, 0.6% maximum manganese, 0.5% maximum zinc, balance aluminum. This alloy is adaptable to be used in the die casting, permanent mold casting, and the semi-permanent mold casting with sand cores processes, as well as the traditional sand casting processes noted above. This alternative alloy may be modified to contain 0.3-0.7% by weight magnesium; 0.6% by weight maximum iron, 0.2% by weight maximum manganese, 0.2% by weight maximum copper; and 0.1% by weight maximum zinc. Furthermore, up to 2% by weight nickel may be substituted with up to 2% by weight cobalt. Further, the constituency may be modified to contain 0.75-1.2% by weight magnesium or 0.2% by weight maximum iron.

The alloy of the present invention has a T6 heat treated microstructure of primary silicon particles embedded in eutectics of Al—Si and Al—$NiAl_3$ and is generally free of unsolutionized $Mg_2Si$ phases and $Cu_3NiAl_6$ in Chinese script form. The hypereutectic aluminum silicon alloy of the present invention has an anticipated use with a lost foam casting with pressure process to cast engine components such as engine blocks, engine heads and pistons, particularly when such components are to be used in salt water where high corrosion resistance is required. The alloy in the present invention provides high mechanical properties (through low porosity levels) both at ambient temperatures and at elevated temperatures.

Achieving high corrosion resistance and low porosity levels necessitates an alloy composition low in copper content. Copper is extensively soluble in aluminum, reaching 5.65% at the binary Al—Si eutectic temperature and, as a result, copper destroys the corrosion resistance of aluminum to a greater extent than any other common element in the periodic table. Aluminum silicon alloys containing copper precipitate the copper containing phases at low temperatures during solidification after the precipitation of the primary aluminum phase. This low temperature, late precipitation event clogs the interdendritic feed passageways created by the primary aluminum silicon dendritic. As a result, the copper containing aluminum silicon alloys cast with the lost foam casting process of U.S. Pat. No. 6,763,876 typically contain ten times the level of porosity that can be obtained with the copper free aluminum silicon alloys.

The present invention describes system engineered design changes based on the introduction of the $NiAl_3$ phase into an aluminum silicon eutectic microstructure. These design changes provide partitions in the aluminum silicon eutectic that increase machinability and provide an intermetallic compound constituent in the eutectic having greater galvanic couple compatibility in a salt water environment than with aluminum-nickel or aluminum-silicon.

Clogging of the interdendritic passageways for alloys with high iron constituencies (e.g., AA 336 and AA 393) may occur because the iron phase forms long, needle like phases during solidification, clogging the interdendritic passageways and causing the alloy to have high microporosity, even with the application of ten atmospheres of pressure. In contrast, the "Chinese script" phase morphology of an Ni—$Al_3$ eutectic phase is coarse and intermixed with aluminum silicon eutectic when formed under sand casting cooling rates in the ternary reaction ($Liq>Si+Al+NiA_3$). Significantly, the coarse phase $NiAl_3$ starts to precipitate, particularly for Ni compositions above 6%, before the ternary eutectic temperature is reached. The $NiAl_3$ network, because of its open structure at the micron level, is quite permeable for the liquid constituents that do not contain solid copper phases or solid iron phases and thus, this morphology does not hinder the interdendritic feeding of molten aluminum when under ten atmospheres of isostatic gas pressure are applied. As a result, hypereutectic aluminum silicon magnesium alloys containing nickel, but having low levels of both iron and copper, have lower porosity levels, when sand cast using ten atmospheres of gas pressure in a lost foam with pressure casting process.

During solution heat treating of "as cast" samples, there is a clear difference between copper containing hypereutectic aluminum silicon alloys with nickel and copper free hypereutectic aluminum silicon alloys with nickel. Solution heat treating solubilizes $Mg_2Si$ and most of the $Cu_3NiAl_6$ phase, but only causes simple rounding of the silicon and $NiAl_3$ particles. The phenomenon occurs because silicon and $NiAl_3$ are basically insoluble in aluminum, while magnesium and copper are extensively soluble in aluminum. Thus, results suggest that silicon and $NiAl_3$ should provide strength and stability at elevated temperatures to a greater extent than magnesium, copper and manganese. The results also suggest that microstructures obtained with the copper free aluminum silicon alloys containing nickel are relatively stable at room temperatures after slow cooling through the solidification event. Fast cooled samples, on the other hand because of coring, would be expected to be less stable at elevated temperatures.

Additionally, it has been realized that when nickel is added to the eutectic constituents as an $NiAl_3$ compound rather than as a pure element (that is insoluble in aluminum), there is no uncombined nickel (i.e., "free nickel") present in the microstructure. This is significant because free nickel affects galvanic corrosion phenomena adversely, while $NiAl_3$, as aforementioned, has beneficial effect of facilitating corrosion resistance.

It is known that in man-made metal matrix composites, the volume fraction of the reinforcing phase is increased by artificially adding more of the reinforcing phase. With eutectics, the volume fraction of the reinforcing phase (i.e., the "fiber phase") and the matrix phase are fixed by nature by the eutectic composition and by the compositions of the phases in equilibrium at the eutectic temperature.

The AA B391 alloy is associated with a binary Al—Si eutectic that has a long arrest temperature isotherm at 577° Celsius. The long arrest isotherm causes liquid styrene defects when cast in the lost foam casting process, because the molten B391 alloy near its solidus temperature is 90 weight % liquid and only 10 weight % solid. In the present invention, another arrest temperature for the $NiAl_3$ eutectic at 640° Celsius enters the solidification profile of the alloy. This arrest temperature not only provides a time frame for the liquid styrene to escape, but also enhances the feeding of shrinkage porosity. Copper containing aluminum silicon alloys with nickel in addition to the above, would also contain the $Cu_3NiAl_6$ phase in Chinese script form that would aid in machinability but would contain low melting copper phases that precipitate late in the solidification process and clog the feed passageways, preventing the attainment of low porosity levels, even when solidified under 10 atmospheres of gas pressure.

The copper free hypereutectic aluminum silicon alloys, with a solidus melting point of nearly 100° Fahrenheit higher than the copper containing hypereutectic aluminum silicon alloys, do not precipitate low melting point phases that clog the interdendritic passageways feeding this shrinkage porosity. Thus, the coarse, Chinese script morphology of the $NiAl_3$ phase in the Al—$NiAl_3$ eutectic, when solidified under sand casting cooling rates, enhances the feeding of shrinkage porosity because of the $NiAl_3$ size and morphology relative to the eutectic silicon phase.

The present invention utilizes the Al—$NiAl_3$ binary eutectic as it extends with increasing silicon content into the bivariant (i.e., two degrees of freedom) temperature plane of the Al—$AlNi_3$—Si phase diagram, to provide a source of the $NiAl_3$ phase in "Chinese script" morphology form with a 14% $NiAl_3$ for 6% nickel composition.

Accordingly, the $NiAl_3$ is preferably introduced into the eutectic and does not materially change the initial primary silicon volume fraction. Further, the $NiAl_3$ addition imparts high wear properties because long tie lines from essentially pure silicon to the Al—Si eutectic equilibrium remain relatively constant. However, the $NiAl_3$ addition increases the volume fraction of the eutectic constituents, and accordingly, less Al—Si eutectic must freeze at the lowest temperatures. This is advantageous in the lost foam casting process because, compared to a normal binary eutectic, all of the solidification does not have to occur at one temperature. Accordingly there is a lengthened time frame with an organized sequence of solidification events over a range of temperatures. The job of "feeding" shrinkage (e.g., with pressure) and providing time for the liquid styrene to vaporize and escape through the coating on the foam therefore increases. This extra time for solidification is particularly important in the lost foam process because an advancing metal front that ablates a foam gating system and mold and provides heat energy for the foam to evaporate proceeds throughout the gating system and mold at or near its solidus temperature. Thus, the molten metal front is usually near freezing even before filling is complete, particularly if the metal has to travel a significant distance through the foam gating system and mold. Furthermore, for the eutectic composition, the molten metal has a very low viscosity and may engulf and trap unvaporized liquid styrene as the metal front freezes, leading to casting defects. If, as solidification proceeds, a gradual increase in the viscosity of the melt occurs, liquid styrene entrapment at the final stages of solidification is minimized. This is beneficial to the quality of the casting as defects are reduced. Accordingly, because the alloy of the present invention, with the $NiAl_3$ compound addition creating either a binary Al—$NiAl_3$ eutectic equilibrium or a ternary Al—Si—$NiAl_3$ eutectic that occur at a higher temperature than the Al—Si eutectic, effectively the temperature of the eutectic is raised and the viscosity of the melt is increased by 10 to 15%. Thus, entrapment of styrene is prevented and further associated casting defects are essentially eliminated.

Thermodynamically, the heat fusion of aluminum is quite high at 92.7 calories per gram, while the heat of fusion of $NiAl_3$ is 68.4 calories per gram. However, the heat of fusion of silicon is much higher at 430 calories per gram, nearly five times that of aluminum and over six times that of $NiAl_3$. Thus, as a nickel free hypoeutectic aluminum silicon alloy solidifies and gives off 430 calories per gram as the primary silicon precipitates, there is a tendency for the temperature gradient on the aluminum to decrease. The decrease of the temperature gradient of the aluminum reduces the heat input to the melt and causes shrinkage porosity to become more difficult to feed.

In contrast, as the hypereutectic aluminum silicon alloy of the present invention solidifies and $NiAl_3$ precipitates out of solution, only 68.4 calories per gram of heat are given off. Thus, during this early stage of solidification when $NiAl_3$ is precipitating out of the solution, a larger temperature gradient is expected and, as a result, the feeding efficiency of the shrinkage porosity is greater than when compared to an alloy without nickel. The addition of the $NiAl_3$ compound thus provides favorable conditions in the lost foam casting process for the liquid styrene to vaporize and escape through the coating on the foam, decreasing the amount of eutectic liquid that will have to go through the Al—Si eutectic during the last stages of solidification for the alloy, and further increasing shrinkage porosity feeding efficiency.

One embodiment of the present invention sets an upper limit of 6% nickel. Higher values of nickel would involve the $NiAl_3$ phase not only as a phase solely coming from the Al—$NiAl_3$ eutectic, but also as a primary phase. This would involve a liquidus temperature steeply rising with increasing nickel content and a temperature above the melting point of pure aluminum all of which works against the attributes needed for a good sand casting alloy. At 6% nickel, the binary $NiAl_3$ eutectic reaction produces a eutectic that is 14.3% $NiAl_3$. This is the maximum amount of eutectic $NiAl_3$ that can be obtained; it is fixed by nature. At 3% nickel, only half of the 14.3% $NiAl_3$ is obtained. At 2% nickel, only ⅓ of the $NiAl_3$ is obtained. Thus, for practical reasons, 3% by weight nickel was chosen as the lower limit because of the diminishing benefits in going to lower nickel concentrations. Furthermore, there is both a machining and high temperature strength advantage of having a volume fraction of the $NiAl_3$ phase that exceeds the primary silicon volume fraction. This is more likely to be seen for nickel contents greater than 4.5% by weight.

As aforementioned, the nickel containing alloy of the present invention is primarily intended for sand casting processes where the iron content is low and the manganese content is low. For those casting processes where the iron content may be above 0.2%, and in particular above 0.3% by weight, cobalt up to 2% by weight, preferably only up to 1% by weight, may be substituted for an equivalent amount of nickel. The advantage of such substitution is that the cobalt modifies the needle like morphology of the aluminum beta phase.

Magnesium is present in the alloy of the present invention for its age hardening response. Under the conditions of equilibrium for hypereutectic aluminum silicon alloys, $Mg_2Si$ does not appear visible at less than 2000× magnification in the as cast condition as a coarse constituent of the eutectic until a magnesium content of about 0.75% has been attained. Also, when the magnesium level is kept below 0.75%, aluminum, silicon and $Mg_2Si$ form a ternary eutectic containing 4.97% magnesium, and 12.95% silicon and freezes at 555° Celsius.

Silicon is present in the proposed alloy for the wear resistance properties imparted by the hard primary silicon particles. Compared to the standard AA 390 alloy which can have a silicon content as low as 16% by weight, the proposed alloy has a minimum silicon content of 18% by weight. Accordingly, this silicon level contains 50% more primary silicon for wear resistance. Silicon levels higher than 20% by weight will contain 100% more primary silicon particles than a 16% by weight silicon alloy, but are not advised because the liquidus is above 700° Celsius.

The electrolytic potential of the $NiAl_3$ compound is negative 0.73 volts, as compared with negative 0.85 volts for pure aluminum. The potential of aluminum-nickel alloys decreases slowly from pure aluminum to $NiAl_3$. Metals with large positive standard electrode potentials (e.g., Au, Ag, Cu) show very little tendency to dissolve in water and are known as noble metals. However, base metals with a negative standard electrode potential have a tendency to dissolve in water or corrode, such as magnesium and sodium. Thus, a galvanic couple between aluminum and $NiAl_3$ shows a slight tendency of the less noble aluminum metal in the system to dissolve in the electrolyte. The galvanic corrosion of aluminum coupled to pure nickel would be expected to be far worse because nickel is significantly more noble than $NiAl_3$. Thus, since the nickel is entirely tied up in the $NiAl_3$ compound, the addition of nickel to the alloy does not decrease the alloys application for salt water use. In fact, the potential difference for the Al—$NiAl_3$ couple in salt water is less than the potential difference for the Al—Si couple in salt water.

Pistons are the engine components that require the highest elevated temperature properties. A low thermal expansion coefficient is of paramount importance in selecting a material for piston construction. Nickel decreases the thermal expansion coefficient of aluminum to a greater extent than any other element and, at a 6% nickel addition, the thermal expansion coefficient of aluminum decreases by approximately 10%. High thermal conductivity is also a very important property for piston construction because the combustion heat of the engine must be dissipated. However, elements that dissolve in aluminum in the solid state solution affect the lattice structure and decrease the thermal conductivity of aluminum. Accordingly, heat treating procedures that cause the precipitation of phases from solution in aluminum, such as the T5 heat treatment versus the T6 heat treatment, is the appropriate heat treatment for an aluminum piston alloy.

It is known that nickel is insoluble in aluminum in the solid state. Nickel has no measurable effect on the thermal conductivity of aluminum because the maximum solubility of nickel and aluminum is approximately 0.04%. Nickel forms a eutectic with aluminum at the aluminum end of the Al—Ni binary diagram. The Al—Ni eutectic requires a liquid alloy of approximately 6% by weight nickel to decompose at 6400 Celsius on cooling to a mechanical mixture of basically "pure" solid aluminum and $NiAl_3$. This solidified alloy has a density of approximately 2879 kg/m$^3$. This density is less than the expected algebraic calculated density of 3072 kg/m$^3$ for a 6% addition of nickel because the $NiAl_3$ expands upon solidification.

Referring now to the Al—Ni binary phase diagram of FIG. 1, although a phase equilibrium diagram for the Al—Si—$NiAl_3$ ternary system does not exist, it will be recognized by those skilled in the art that a ternary eutectic transformation liquid>Al+$NiAl_3$+Si occurs at approximately 5% Ni, 11-12% Si at 557° C. In the solid state the three phases Al, $NiAl_3$, and Si are present in most of the alloys. The solubility of silicon in $NiAl_3$ is of the order of 0.4-0.5%; the solubility of nickel in aluminum is only 0.04% at the binary eutectic temperature and that of silicon is reduced by nickel additions. This knowledge, combined with the Al—Ni phase diagram of FIG. 1 demonstrates that there is a three phase equilibrium for the Al—Si—$NiA_3$ ternary system. Thus, a ternary diagram may be constructed demonstrating that equilibrium occurs over a temperature range and not, as in binary systems, at a single temperature, as demonstrated in FIG. 2. According to the Gibbs' Phase Rule, the three phase equilibrium in the ternary system is bivariant. The Gibbs' Phase Rule states that the maximum number of phases (P) that can coexist in a chemical system or alloy, plus the number of degrees of freedom (F) is equal to the sum of the components (C) of the system plus 2. This, in the Al—Si—$NiAl_3$ equilibrium, two degrees of freedom exists because there is a maximum number of 3 phases that can coexist and 3 components of the system exist since F=[C+2]−P according to the Gibbs' Phase Rule. Accordingly, after the pressure has been selected, only the temperature or one concentration parameter need be selected in order to fix the conditions of equilibrium.

The representation of a three-phase equilibrium on a phase diagram requires the use of a structural unit that will designate, at a given temperature, the fixed composition of three conjugate phases (i.e., the Al phase, the Si phase and the $NiAl_3$ phase). The structural unit is found in the "tie triangle" of FIG. 2, where R represents the Al phase, S represents the $NiAl_3$ phase and L represents the Si phase. The triangle R-S-L connects the three phases that the original phase P decomposes into. Using P as the experimental condition 20% Si, 6% Ni and approximately 73% Al, and using the formulas, tabulated in FIG. 2, to calculate the percentage of $NiAl_3$ and percentage of silicon, the percentage of $NiAl_3$ is determined to be 11% and the percentage of silicon is determined to be 8%. These calculations are in reasonable agreement [i.e., + or −1% for $NiA_3$ and + or −0.5% for silicon] with quantitative metallography that was measured on ten samples.

It has been observed that the $NiAl_3$ phase precipitates out of the alloy at about a 14% quantity as a semi-continuous mass of "Chinese script" phases in the eutectic structure between primary silicon particles. Meanwhile, the primary silicon volume fraction is approximately 8% in the same sand cast microstructure. This unique microstructure is particularly important for improved machinability and further provides the appropriate reinforcement for elevated temperature creep strength and other elevated temperature properties, making the alloys of the present invention an excellent choice of material for piston construction.

The present invention is further detailed in the following examples.

EXAMPLES

Example 1

Pistons for an internal combustion engine were cast with an alloy according to the present invention and having the following specific constituents in weight percentage: 19% silicon, 0.6% magnesium, 4% nickel and balance aluminum. The pistons were cast using a traditional sand casting method. The cast pistons were heat treated and subsequently machined.

The machining of the pistons went so well that it was suspected that the alloy was not a hypereutectic aluminum silicon alloy. The machining results were so surprising that instead of carbide tooling or diamond tooling, high speed steel was sufficient to machine the pistons. Further, in comparison tests with pistons cast from AA B391, the pistons using the alloy of the present invention gave lower emission numbers than in pistons cast from AA B391. The lower emission numbers are attributable to higher temperature strength of the alloy of the present invention, as well as the lower the coefficient of thermal expansion of the alloy of the present invention.

Example 2

A two cylinder engine block was cast using the lost foam casting with pressure process wherein ten atmospheres of pressure were applied during solidification. The two cylinder engine block was cast from an alloy of the present invention and specifically comprising 19.1% silicon, 0.65% manganese and 5.2% nickel. After casting, the porosity level of the two cylinder block was measured to be 0.11%.

The porosity value of 0.11% is significantly lower than the best porosity levels (of approximately 0.35%) that have been measured for copper-containing hypereutectic aluminum silicon alloys solidified under 10 atmospheres of pressure under identical conditions in the identical foam blocks. The tensile strength from samples obtained from a block cast from the alloy of the present invention tested at 700° Fahrenheit had a tensile strength of 10.5 ksi. The machining results for a machining trial of 100 engine blocks were surprising as to the results in Example 1 with the pistons, and, accordingly, allowed for high speed steel machining.

The above demonstrated examples constitute 100% improvement in projected tool life for machining components constructed of alloys of the present invention versus machining components constructed of aluminum alloy B391. Since pistons, engine blocks and engine heads are engine components that require an extensive amount of machining after casting, this invention is particularly suited therefor.

It should be apparent to those skilled in the art that the present invention as described herein contains several features, and that variations to the various embodiments disclosed herein may be made which embody only some of the features disclosed. Various other combinations, and modifications or alternatives may also be apparent to those skilled in the art. Such various alternatives and other embodiments are contemplated as being within the scope of the following claims which particularly point out and distinctly claim the subject matter regarded as the invention.

What is claimed is:

1. A hypereutectic aluminum silicon sand cast alloy consisting essentially of 18-20% by weight silicon, 0.3-1.2% by weight magnesium, 3-6% by weight nickel, wherein the alloy is substantially free of iron, copper and manganese and the balance aluminum.

2. The alloy of claim 1, wherein the alloy is sand cast using one of the following sand cast procedures: lost foam casting, lost foam with pressure casting, green sand casting, bonded sand casting, precision sand casting, investment casting.

3. The alloy of claim 1, wherein the nickel content 4.0-5.2% by weight.

4. The alloy of claim 1 wherein the alloy has a T-6 heat treated microstructure of primary silicon particles embedded in eutectics of Al—Si and Al—$NiAl_3$ and is substantially free of unsolutionized $Mg_2Si$ phases.

5. The alloy of claim 4, wherein the amount of the eutectic $NiAl_3$ phase is between 5% and 15% by weight.

6. The alloy of claim 3 wherein the alloy has a T-6 heat treated microstructure of primary silicon particles embedded in eutectics of Al—Si and Al—$NiAl_3$ and is substantially free of unsolutionized $Mg_2Si$ phases and the amount of the eutectic $NiAl_3$ phase is greater than 10%.

7. The alloy of claim 4, wherein eutectic $Cu_3NiAl_6$ phase is present: in less than 1% by weight.

8. The alloy composition of claim 1, wherein the magnesium content is 0.75-1.2% by weight, and $Mg_2Si$ phase is visible at less than 2000× magnification in the as cast condition.

9. The alloy composition of claim 1, wherein 1% by weight nickel is substituted with up to 1% by weight cobalt.

10. The alloy composition of claim 1, wherein 2% by weight nickel is substituted with up to 2% by weight cobalt.

11. The alloy of claim 1, wherein a grain or silicon refining element is added.

12. A hypereutectic aluminum silicon sand cast alloy consisting essentially of 18-20% by weight silicon, 0.3-0.7% by weight magnesium, 3.0-5.2% by weight nickel, wherein the alloy is substantially free of iron, copper and manganese and the balance aluminum, wherein the alloy is sand cast using a lost foam casting process with pressure.

13. The alloy of claim 12, wherein the pressure is applied in the range of 5.5. to 15 ATM at a rate faster than 1 ATM per 12 seconds after ablation of a polymeric foam gating system, but before molten metal fully ablates a polymeric foam pattern corresponding in configuration to an article to be cast.

14. The alloy of claim 13, wherein said pattern is of an internal combustion engine block exhibiting a porosity level less than 0.5%.

15. The alloy of claim 13, wherein said pattern is one of an engine head, a piston for an internal combustion engine, and an internal combustion engine block; and the porosity level is less than 0.1%.

* * * * *